US005390510A

United States Patent [19]

Tirio-Cloonan

[11] Patent Number: 5,390,510

[45] Date of Patent: Feb. 21, 1995

[54] PENDENT HAVING COMPACT AND DECORATIVE SCENT RECEPTACLE

[75] Inventor: Patricia P. Tirio-Cloonan, Gardena, Calif.

[73] Assignee: Mattel, Inc., El Segundo, Calif.

[21] Appl. No.: 4,368

[22] Filed: Jan. 14, 1993

[51] Int. Cl.[6] ..... A47C 13/00; A63H 3/00

[52] U.S. Cl. ..... 63/1.1; 63/18; 446/74; 446/76; 446/267; 132/294; 132/297

[58] Field of Search ..... 63/1.1, 2, 18, 19; 446/74, 76, 267; 132/294, 297, 293

[56] References Cited

U.S. PATENT DOCUMENTS

| | | | |
|---|---|---|---|
| D. 100,412 | 7/1936 | Carp | 215/6 |
| D. 204,438 | 4/1966 | Rogers . | |
| 1,490,484 | 4/1924 | Rosenhaft et al. | 132/294 |
| 1,490,878 | 4/1924 | Wilde | 132/294 |
| 1,538,786 | 5/1925 | Feldmann . | |
| 1,632,864 | 6/1927 | Weber | 132/294 |
| 1,823,814 | 9/1931 | Aiello . | |
| 1,983,382 | 12/1934 | Marsh . | |
| 2,450,620 | 10/1948 | Speicher . | |
| 2,491,166 | 12/1949 | Di Stiso . | |
| 2,751,764 | 6/1956 | Hudes et al. | 63/1.1 |
| 3,270,525 | 9/1966 | Sellers . | |
| 4,081,972 | 4/1978 | Kotlar . | |
| 4,142,383 | 3/1979 | Eberhart . | |
| 4,208,888 | 6/1980 | Erdman et al. | 428/28 |
| 4,224,757 | 9/1980 | Kelley . | |
| 4,542,631 | 9/1985 | Esser, III . | |
| 4,581,904 | 4/1986 | Lehmann et al. . | |
| 4,592,478 | 6/1986 | Laconis | 215/6 |
| 4,703,927 | 11/1987 | Hanzlik | 215/6 |
| 4,726,200 | 2/1988 | Carter . | |
| 4,866,952 | 9/1989 | Hight et al. . | |
| 4,879,882 | 11/1989 | Johnson et al. . | |
| 4,936,324 | 6/1990 | Chen | 132/294 |
| 4,936,699 | 6/1990 | Yoshida . | |
| 4,958,740 | 9/1990 | Wilkerson | 220/555 |
| 5,006,375 | 4/1991 | Mangan . | |
| 5,092,807 | 3/1992 | Lew et al. | 428/13 |

FOREIGN PATENT DOCUMENTS

| | | | |
|---|---|---|---|
| 614764 | 2/1961 | Canada | 215/6 |

*Primary Examiner*—Michael J. Milano
*Attorney, Agent, or Firm*—Roy A. Ekstrand

[57] ABSTRACT

A pendent defines a generally heart-shaped housing having an interior cavity formed therein and an internal heart-shaped aperture at its center. A planar support base is formed at the lower portion of the heart-shaped housing while an upwardly extending cylindrical neck portion is formed in the upper portion of the heart-shaped housing. A cap includes a cylindrical stopper receivable within the housing neck to provide closure of the interior cavity thereof. The heart-shaped housing interior cavity is divided by an interior wall into a closed sealed cavity portion which receives and supports a liquid and glitter particle combination. The remaining portion of the housing interior cavity is accessible through the neck portion to provide a refillable reservoir for liquids such as cologne, perfume or the like. A heart-shaped compact having mating half portions is receivable within the heart-shaped interior aperture of the housing and is securable to the pendent by a tight fit therebetween. A ring includes a generally U-shaped resilient clasp receivable upon the neck portion of the pendent and bearing an ornamental article to further enhance the appearance of the pendent.

11 Claims, 1 Drawing Sheet

PENDENT HAVING COMPACT AND DECORATIVE SCENT RECEPTACLE

FIELD OF THE INVENTION

This invention relates generally to children's jewelry articles and particularly to those used to contain a scented liquid.

BACKGROUND OF THE INVENTION

In many play situations young girls often play with scented liquid or "perfume" together with a variety of jewelry articles and makeup. To provide such playsets, practitioners in the art often provide various combinations of jewelry articles and scent containers for children's use.

For example, U.S. Pat. No. 5,006,375 issued to Mangan sets forth an ORNAMENTAL ARTICLE comprising a transparent housing shaped into a decorative configuration such as a heart and having a liquid supported within an interior cavity. The cavity is maintained at a subatmospheric pressure such that ambient temperatures cause the liquid to boil and agitate particles or larger objects within the liquid.

U.S. Pat. No. 4,142,383 issued to Eberhart sets forth a LIQUID FILLED SEALED GLASS ORNAMENT AND METHOD for production of decorative objects by providing a viscous liquid and particulate material within a hollow glass envelope. A cap is bonded to the glass envelope to provide a means of attachment to a suspending chain or the like to permit wearing of the ornament.

U.S. Pat. No. 3,270,525 issued to Sellers sets forth PERFUME DISPENSING JEWELRY WITH FRANGIBLE PORTION in which a hollow jewelry article is provided with an interior cavity supporting a scented liquid and a pierceable aperture which permits the scented liquid to disperse outwardly from the jewelry article.

Still other prior art devices set forth compacts or lockets having interior compartments accessible to the user. For example, Design Patent 204,438 sets forth a heart-shaped compact having a hingeable portion or cover and an interior cavity.

U.S. Pat. No. 2,450,620 issued to Speicher sets forth a LOCKET for receiving and supporting a jewel item or the like.

U.S. Pat. No. 4,581,904 issued to Lehmann, et al. sets forth a TOY JEWELRY ITEM WITH PARTS MOVABLE TO A HIDDEN POSITION in which a plurality of attachable parts are securable at different positions to a box-shaped pendent through edge attachment.

U.S. Pat. No. 4,866,952 issued to Hight, et al. sets forth a PENDENT CONTAINER FOR TABLETS AND CAPSULES in which a hollow elongated pendent is formed of interlocking half portions having a cavity therein for supporting medicine or tablets or the like.

U.S. Pat. No. 4,726,200 issued to Carter sets forth a COMBINATION RING PENDENT in which a pendent is formed of a pair of articles having a second configuration which forms a ring.

U.S. Pat. No. 4,542,631 issued to Esser III sets forth JEWELRY AND THE LIKE ADAPTED TO DEFINE A PLURALITY OF OBJECTS OR SHAPES in which a pair of elongated jewelry items are securable in a plurality of orientations to form different shaped items for differently shaped jewelry articles.

U.S. Pat. No. 4,879,882 issued to Johnson, et al. sets forth JEWELRY WITH INTERCHANGEABLE ELEMENTS having a pendent support and a plurality of bead-like devices receivable upon the pendent support in different arrangements.

U.S. Pat. No. 4,936,699 issued to Yoshida sets forth TOY ACCESSORIES having a base member defining plural engaging parts. A plurality of ornamental parts are provided for interlocking with the base member by the plural engaging parts.

Still other prior art devices set forth various cases and vanity materials for combination of elements. For example, U.S. Pat. No. 4,224,757 issued to Kelley sets forth a TOY PERFUME MAKER having a liquid container, a mixing device and additional apparatus for making scented material. Similarly, U.S. Pat. No. 1,538,786 issued to Feldmann sets forth a VANITY BOX having hinge coupled members while U.S. Pat. No. 1,823,814 issued to Aiello sets forth a WRIST COMPACT which sets forth a small hinged coupled box having a wrist supporting band. U.S. Pat. No. 1,983,382 issued to Marsh sets forth a VANITY CASE having a suspending chain while U.S. Pat. No. 2,491,166 issued to DiStiso sets forth a PIN-UP VANITY CASE HOLDER having a pin supporting base for receiving a locket or the like. U.S. Pat. No. 4,081,972 issued to Kotlar sets forth a PENDENT, EARRING OR PIECE OF JEWELRY having an external cage defining a plurality of openings therein and an interior cavity receiving a plurality of ornamental articles.

While the foregoing described prior art devices have provided some amusement and entertainment for young children, there remains nevertheless a continuing need in the art for evermore interesting and exciting play articles and playsets incorporating jewelry and perfume themes for young children.

SUMMARY OF THE INVENTION

Accordingly, it is a general object of the present invention to provide an improved jewelry and play article. It is a more particular object of the present invention to provide an improved jewelry and play article which is configured as a pendent and which supports a plurality of associated play articles.

In accordance with the present invention, there is provided a pendent comprises: a housing defining a first interior cavity in communication with the neck for receiving a liquid such as perfume or the like and a second sealed interior cavity, a neck portion and an internal aperture; a compact receivable within the internal aperture; a cap receivable within the neck portion of the housing; and a quantity of liquid having a plurality of decorative particles therein received within the second interior cavity.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
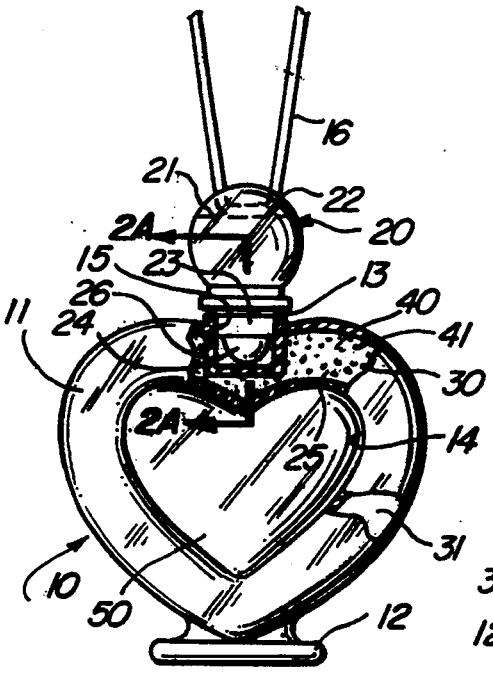
FIG. 1 sets forth a partially sectioned front view of a pendent constructed in accordance with the present invention.

FIG. 1 sets forth a partially sectioned front view of a pendent constructed in accordance with the present invention and generally referenced by numeral 10. Pendent 10 includes a heart-shaped housing 11 having a generally planar support base 12 at the lower portion thereof. Housing 11 further defines an upwardly extending neck portion 13 defining an interior generally cylindrically shaped stopper housing 26. Housing 26 defines a closed end cylindrical member having a fill aperture 32 (better seen in FIG. 2A) at the lower portion thereof. As is also better seen in FIG. 2, housing 11 further defines a center wall 25 extending continuously through housing 11 and dividing housing 11 vertically into a frontal cavity 30 and a rear cavity 31. Frontal cavity 30 and rear cavity 31 are generally coextensive with heart-shaped housing 11. Aperture 32 provides communication between neck aperture 15 formed in stopper housing 26 and rear cavity 31. Conversely, frontal cavity 30 is sealed and is not provided with communication to neck aperture 15 of stopper housing 26.

Returning to FIG. 1, housing 11 further defines a heart-shaped interior aperture 14 which receives and supports a heart-shaped compact 50. The structure of compact 50 is better seen in FIGS. 3 and 4. However, suffice it to note here that compact 50 is received within interior aperture 14 in a tight interference fit which permits compact 50 to be secured to housing 11 in the manner shown in FIGS. 1 and 2.

Pendent 10 further includes a cap 20 having a ball-shaped portion 21 defining an aperture 22 extending therethrough. A ribbon 16 preferably sized to permit the wearing of pendent 10 around the user's neck and defining a closed loop support member is passed through aperture 22. Cap 20 further defines a cylindrical stopper 23 received within stopper housing 26 in a sealing fit with neck aperture 15. A small lipstick 24 is supported at the lower end of stopper 23 and secured thereto by conventional attachment means.

In the preferred form of the embodiment of the present invention set forth in FIG. 1, frontal cavity 30 receives and supports a quantity of confined liquid 40 which in turn supports a plurality of glitter particles 41. It its preferred form, housing 11 is fabricated of a transparent clear or colored transparent molded plastic material which permits the glitter particles within frontal cavity 30 to be seen and provide an interesting visual effect for pendent 10. In addition, a quantity of scent materials such as perfume or the like is received within rear cavity 31 through fill aperture 32 permitting pendent 10 to provide a convenient repository for scent material such as perfume or the like. In addition to being wearable around the user's neck or wrist or other attachment such as to clothing articles using ribbon 16, pendent 10 may be supported upon base 12 upon a support surface such as a dressing table or the like to provide a convenient perfume bottle article for a typical child user.

Compact 50 is preferably formed of a molded plastic material or the like and may bear appropriate decorative exterior features or colors in accordance with the user's preference or taste. In addition and as is better seen in FIG. 6, a ring generally referenced by numeral 90 may be receivable upon neck 13 in a snap-fit attachment to provide additional ornamentation for pendent 10.

Figure 2:
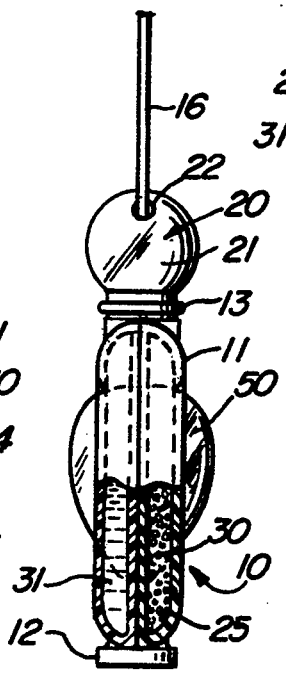
FIG. 2 sets forth a partially sectioned side view of a pendent constructed in accordance with the present invention.

FIG. 2 sets forth a partially sectioned side view of pendent 10 showing the relative positions of frontal cavity 30, wall 25 and rear cavity 31. Thus, as described above, pendent 10 includes a heart-shaped housing 11 defining a wall 25 therein separating housing 11 into frontal cavity 30 and rear cavity 31. A base 12 is secured to the bottom portion of housing 11 and provides a rest or support for pendent 10. Housing 11 also defines an upwardly extending neck 13 formed of a stopper housing 26 having a closed end neck aperture 15 and a fill aperture 32 formed therein. A cap 20 includes a ball portion 21 having a cylindrical stopper 23 extending into and sealingly fitted within neck aperture 15. Stopper 23 supports lipstick 24 in accordance with a conventional attachment. As is also described above, a quantity of liquid 40 having a plurality of glitter particles 41 is sealingly captivated within frontal cavity 30 to provide a decorative front effect for clear or transparent colored housing 11. Rear cavity 31 is preferably filled with a scented material 33 such as a liquid cologne or perfume or the like which is introduced into rear cavity 31 through fill aperture 32 when cap 20 is removed therefrom. As is also seen in FIG. 2, heart-shaped compact 50 is fitted within interior aperture 14 of housing 11 to secure compact 50 to pendent 10.

Figure 2A:
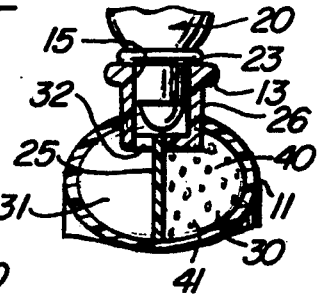
FIG. 2A sets forth a partial section view of the present invention pendent taken along section lines 2A—2A in FIG. 1.

FIG. 2A sets forth a section view of the upper portion of pendent 10. As seen therein, pendent 10 includes a neck 13 having a stopper housing 26 defining a fill aperture 32 and receiving a stopper 23. A wall 25 divides housing 11 and forms a sealed frontal cavity 30 and a rear cavity 31 in communication with stopper housing 26 through fill aperture 32. A scented liquid may be introduced into rear cavity 31 through neck 13 and fill aperture 32 when stopper 23 is-removed. Frontal cavity 30 receives a sealed liquid 40 within which a plurality of glitter particles 41 are suspended. Frontal cavity 30 provides a decorative front for pendent 10 while rear cavity 31 provides a container for a scented liquid such as perfume or the like.

Figure 3:
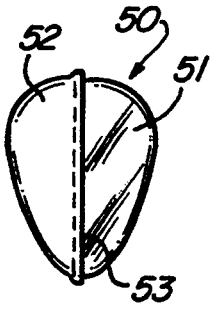
FIG. 3 sets forth a side view of the compact portion of the present invention pendent.

FIG. 3 sets forth a side view of compact 50 in its closed position removed from housing 11 of pendent 10. Compact 50 is preferably heart-shaped and formed of a pair of nesting half portions 51 and 52 which are joined at a junction 53. In its preferred form, compact 50 is fabricated of a molded plastic material or the like and simply snaps together due to the fit between half portions 51 and 52.

Figure 4:
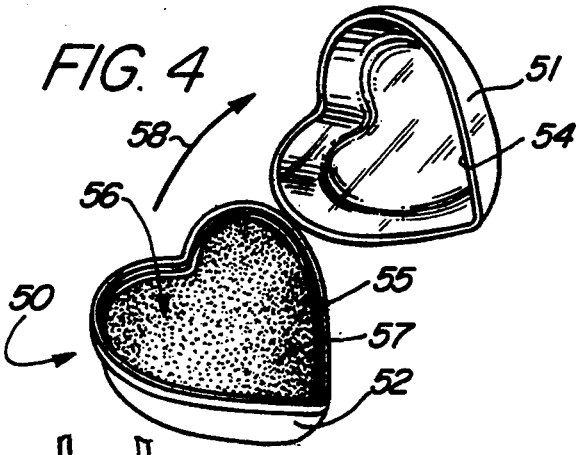
FIG. 4 sets forth a perspective view of the compact portion of FIG. 3 in its open position.

FIG. 4 sets forth a perspective assembly view of compact 50 in the open position. Half portions 51 and 52 are separable to expose an interior cavity 56 within compact 50. In the embodiment of compact 50 shown in FIGS. 3 and 4, half portion 51 defines an edge 54 which is receivable within recess 55 formed in half portion 52 in a snap-fit type union to form junction 53. It will be apparent to those skilled in the art, however, that half portions 51 and 52 may be coupled using a conventional hinge (not shown) in accordance with conventional fabrication techniques if desired. A resilient liner 57 formed of a material such as foam plastic material or the like is supported within interior cavity 56.

Figure 5:
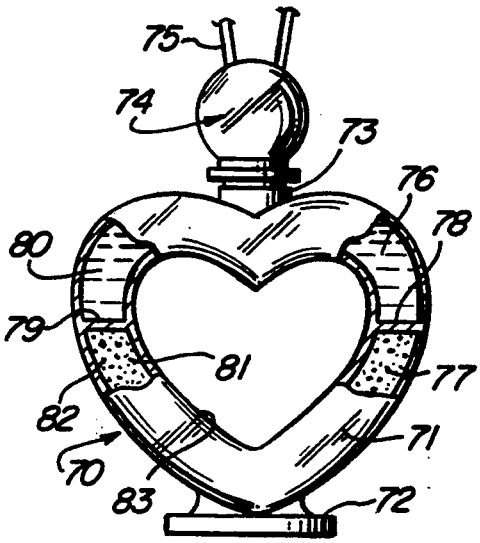
FIG. 5 sets forth a partially sectioned front view of an alternate embodiment of the present invention pendent.

FIG. 5 sets forth an alternate embodiment of the present invention pendent generally referenced by numeral 70. Pendent 70 is similar in physical appearance to pendent 10 and thus defines a heart-shaped housing 71 having an interior aperture 83 formed therein. Housing 71 also defines a base 72 similar to base 12 of pendent 10 and an upwardly extending neck portion 73. A cap 74 having a ribbon 75 secured thereto is generally identical to cap 20 of pendent 10 and is received within a cylindrical fill aperture within neck 73 (not shown). The significant difference between pendent 70 and pendent 10 is the distribution of scented liquid and glitter supporting liquid within housing 71. Unlike housing 11 of pendent 10, housing 71 of pendent is divided into a lower cavity 77 and an upper cavity 76 by a pair of horizontal wall portions 78 and 79. Thus, a quantity of scented liquid 80 such as cologne, perfume or the like is receivable within interior cavity 76 through neck 13 when cap 74 is removed. A quantity of liquid 81 is sealingly captivated within lower cavity 77 and supports a plurality of glitter particles 83 to provide a visual effect within the lower half of housing 71. As described above for pendent 10, pendent 70 may be worn about the user's neck or wrist or secured to the clothing article using ribbon 75. Also, base 72 supports pendent 70 upon a horizontal surface such as a dressing table or the like.

Figure 6:
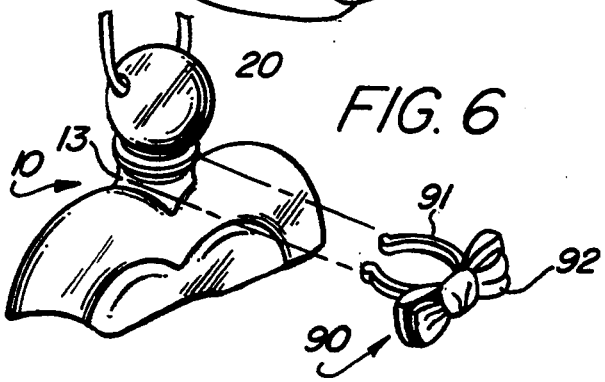
FIG. 6 sets forth a partial perspective assembly view of the present invention pendent.

FIG. 6 sets forth a partial perspective view of pendent 10 showing a ring 90 securable thereto. As described above, pendent 10 defines a neck portion 13 supporting cap 20. Ring 90 defines a generally U-shaped clasp 91 preferably formed of a resilient molded plastic material or the like which receives and supports an ornamental article 92. Ring 90 may be worn upon the user's finger in accordance with a conventional ring-type article and may alternatively be secured to neck 13 of pendent 10 due to the resilience of U-shaped clasp 91 snapping upon neck 13. It should be understood by those skilled in the art that while ring 90 is shown receivable upon pendent 10 in FIG. 6, it is equally well securable to the alternate embodiment of the pendent 10 shown as pendent 70 in FIG. 5.

What has been shown is a novel and interesting pendent article for use by young girls which provides a plurality of interrelated feature elements in a compact pendent which may be worn about the user's neck, wrist or clothing article. The pendent shown utilizes a heart-shaped housing within which a heart-shaped compact is secured to provide a "secret compartment" which may be used to receive any number of articles such as charms, makeup articles or the like. The heart-shaped housing provides a cavity filled with glitter bearing liquid to provide an interesting visual effect. The pendent may be rested upon a planar base at its lower end and facilitates the storage of a quantity of scented liquid such as perfume or the like within a second interior cavity. The article is readily formable of simple molded plastic parts and may be manufactured without excessive costs or complexity.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A pendent comprising:

a housing defining a neck, a first interior cavity in communication with said neck for receiving a liquid such as perfume and a second sealed interior cavity, a neck portion and an internal aperture;

a compact receivable within said internal aperture;

a cap receivable within said neck portion of said housing; and a quantity of liquid having a plurality of decorative particles therein received within said second interior cavity.

2. A pendent as set forth in claim 1 wherein said housing and said internal aperture are generally heart-shaped.

3. A pendent as set forth in claim 2 wherein said housing further includes a support base secured to said housing.

4. A pendent as set forth in claim 3 wherein said compact includes a pair of mating half portions and defines an interior compact cavity.

5. A pendent as set forth in claim 4 wherein said first and second interior cavities are generally heart-shaped and generally coextensive and said housing includes a vertical dividing wall therebetween.

6. A pendent as set forth in claim 4 wherein said housing defines a pair of horizontal dividing walls on opposite sides of said internal aperture between said first and second interior cavities.

7. A pendent as set forth in claim 5 further including a removable ring having a generally U-shaped clasp receivable upon said neck portion and an ornamental article secured to said clasp, said clasp being receivable upon a finger.

8. A pendent as set forth in claim 6 further including a removable ring having a generally U-shaped clasp receivable upon said neck portion and an ornamental article secured to said clasp, said clasp being receivable upon a finger.

9. A pendent as set forth in claim 4 wherein said cap further includes a lipstick supply.

10. A pendent as set forth in claim 1 wherein said first and second interior cavities are generally heart-shaped and generally coextensive and said housing includes a vertical dividing wall therebetween.

11. A pendent as set forth in claim 1 wherein said housing defines a pair of horizontal dividing walls on opposite sides of said internal aperture between said first and second interior cavities.

* * * * *